US005601064A

United States Patent [19]

Fujimoto et al.

[11] Patent Number: 5,601,064

[45] Date of Patent: Feb. 11, 1997

[54] FUEL INJECTION CONTROL SYSTEM FOR INTERNAL COMBUSTION ENGINES

[75] Inventors: Sachito Fujimoto; Yutaka Taniguchi; Ryuji Sato; Keiji Tsujii; Toru Kitamura, all of Wako, Japan

[73] Assignee: Honda Giken Kogyo Kabushiki Kaisha, Tokyo, Japan

[21] Appl. No.: 548,486

[22] Filed: Oct. 26, 1995

[30] Foreign Application Priority Data

Oct. 27, 1994 [JP] Japan ..... 6-287264

[51] Int. Cl.[6] ..... F02D 41/06

[52] U.S. Cl. ..... 123/491

[58] Field of Search ..... 123/478, 480, 123/491, 492, 493, 179.16

[56] References Cited

U.S. PATENT DOCUMENTS

| | | | |
|---|---|---|---|
| 4,184,460 | 1/1980 | Harada et al. | 123/491 |
| 4,438,748 | 3/1984 | Ikeura et al. | 123/491 |
| 5,215,061 | 6/1993 | Ogawa et al. | 123/478 |
| 5,261,370 | 11/1993 | Ogawa et al. | 123/480 |
| 5,383,126 | 1/1995 | Ogawa et al. | 123/492 |
| 5,494,019 | 2/1996 | Ogawa | 123/480 |
| 5,497,752 | 3/1996 | Sagisaka et al. | 123/491 |
| 5,542,393 | 8/1996 | Katoh et al. | 123/491 |

FOREIGN PATENT DOCUMENTS

| | | |
|---|---|---|
| 62-218633 | 9/1987 | Japan . |
| 62-223429 | 10/1987 | Japan . |

*Primary Examiner*—Willis R. Wolfe

*Attorney, Agent, or Firm*—Nikaido, Marmelstein, Murray & Oram LLP

[57] ABSTRACT

A fuel injection control system for an internal combustion engine includes an ECU which carries out adherent fuel-dependent correction by calculating an amount of fuel to be injected into the intake passage such that a sum of a direct supply amount of fuel directly drawn into the combustion chamber of the engine without adhering to the wall surface of the intake passage out of a whole amount of fuel injected into the intake passage, and a carried-off amount of fuel carried off the wall surface of the intake passage into the combustion chamber out of fuel adhering to the wall surface of the intake passage is equal to a required fuel amount for the engine. The starting condition of the engine is detected by sensors, and operation of the adherent fuel-dependent correction control is limited during the starting condition of the engine. The carried-off fuel amount is set to a predetermined value, based on at least one operating parameter of the engine when the engine has shifted from the starting condition to the basic operating condition after starting.

9 Claims, 9 Drawing Sheets

FUEL INJECTION CONTROL SYSTEM FOR INTERNAL COMBUSTION ENGINES

BACKGROUND OF THE INVENTION

1. Field of the Invention

This invention relates to a fuel injection control system for internal combustion engines, which controls an amount of fuel to be injected so as to compensate for an amount of fuel adherent to the wall surface of the intake pipe of the engine.

2. Prior Art

While most of fuel injected by a fuel injection valve into the intake pipe of an internal combustion engine is directly supplied into the combustion chamber of the engine, the remainder of fuel adheres to the wall surface of the intake pipe. A fuel injection amount control system is conventionally known, which estimates an amount of fuel to adhere to the wall surface of the intake pipe and an amount of fuel to be carried off the wall surface into the combustion chamber due to evaporation and other factors (carried-off fuel amount), and then determines an appropriate amount of fuel to be injected (fuel injection amount), by taking into account these estimated amounts of fuel (adherent fuel-dependent correction of the fuel injection amount).

Further, a method of carrying out the adherent fuel-dependent correction is known from Japanese Laid-Open Patent Publication (Kokai) No. 62-218633, in which an adherent fuel amount is calculated during stoppage of the engine, and the adherent fuel-dependent correction is carried out at the next start of the engine, based on the adherent fuel amount calculated during the stoppage of the engine. There is also known a method of setting an initial value of the adherent fuel amount at the start of the engine, according to the temperature of the engine, for example, from Japanese Laid-Open Patent Publication (Kokai) No. 62-223429. These known methods attempt to prevent the inconvenience that at the restart of the engine when only a short time period has elapsed from the termination of the last engine operation, the adherent fuel-dependent correction is effected to an excessive degree in spite of the fact that almost no fuel remains adherent to the wall surface of the intake pipe which still has a high temperature at the restart of the engine.

However, adhesion-dependent correction parameters such as a direct supply ratio which is the ratio of a fuel amount directly drawn into the combustion chamber to the whole fuel amount injected in a cycle, and a "carried-off" time constant which corresponds to a time delay with which fuel adhering to the intake pipe wall surface is carried off into the combustion chamber, are estimated when the engine is operating in a stable condition. More specifically, these parameters are estimated from a response characteristic of the air-fuel ratio of exhaust gases which is obtained by stepwise changing the fuel injection amount in an engine condition where the intake pipe pressure and the engine rotational speed are constant. However, the parameter values are estimated to steady values based on the engine coolant temperature, etc., which are not values quantified based on actually measured values. Therefore, the estimated parameter values obtained at the start of the engine are low in accuracy, which leads to low accuracy of the adherent fuel-dependent correction during the start of the engine. As a result, if the adherent fuel-dependent correction is carried out during the start of the engine, the fuel injection amount may be sometimes corrected to an excessive degree, which unfavorably causes the air-fuel ratio of a mixture supplied to the engine to deviate from a desired value during the start of the engine or immediately after the start of the engine.

To overcome deviation of the air-fuel ratio from the desired value, if the adherent fuel-dependent correction is inhibited during the start of the engine and the correction is started immediately after the start of the engine, e.g. after the engine rotational speed exceeds a predetermined value, the carried-off fuel amount will be calculated to 0 immediately after the start of the engine, and consequently the fuel injection amount immediately after the start of the engine exceeds a required fuel amount, resulting in overriching of the air-fuel ratio of the mixture.

SUMMARY OF THE INVENTION

It is the object of the invention to provide a fuel injection control system for internal combustion engines, which is capable of carrying out the adherent fuel-dependent correction immediately after the start of the engine with high accuracy as well as inhibiting excessive adherent fuel-dependent correction during the start of the engine.

To attain the above object, the present invention provides a fuel injection control system for an internal combustion engine having an intake passage having a wall surface, and at least one combustion chamber, including adherent fuel-dependent correction control means for carrying out adherent fuel-dependent correction by calculating an amount of fuel to be injected into the intake passage such that a sum of a direct supply amount of fuel directly drawn into the combustion chamber of the engine without adhering to the wall surface of the intake passage out of a whole amount of fuel injected into the intake passage, and a carried-off amount of fuel carried off the wall surface of the intake passage into the combustion chamber out of fuel adhering to the wall surface of the intake passage is equal to a required fuel amount for the engine.

The fuel injection control system according to the invention is characterized by an improvement comprising:

engine start-detecting means for detecting a starting condition of the engine;

adherent fuel-dependent correction control-limiting means for limiting operation of the adherent fuel-dependent correction control during the starting condition of the engine; and carried-off fuel amount-setting means for setting the carried-off fuel amount to a predetermined value based on at least one operating parameter of the engine when the engine has shifted from the starting condition to a basic operating condition after starting.

Preferably, the at least one operating parameter of the engine is coolant temperature of the engine, the carried-off fuel amount-setting means setting the predetermined value to a larger value as the coolant temperature of the engine is lower.

Also preferably, the fuel injection control system includes wall surface temperature-estimating means for estimating temperature of the wall surface of the intake passage, based on at least one operating parameter of the engine, and wherein the carried-off fuel amount-setting means sets the predetermined value to a larger value as the estimated temperature of the wall surface of the intake passage is lower.

More preferably, the adherent fuel-dependent correction control-limiting means sets a parameter representative of the direct supply amount of fuel to such a value that the adherent fuel-dependent correction control is carried out to a limited degree.

Further preferably, the adherent fuel-dependent correction control means calculates the amount of fuel to be injected into the intake passage, based on the direct supply amount of fuel, the carried-off amount of fuel, and a parameter representative of a time delay with the carried-off amount of fuel is carried off into the combustion chamber, the adherent fuel-dependent correction control-limiting means setting the parameter representative of the time delay to such a value that the adherent fuel-dependent correction control is carried out to a limited degree.

In a preferred embodiment of the invention, the fuel injection control system is characterized by a further improvement comprising:

engine start-detecting means for detecting a starting condition of the engine;

adherent fuel-dependent correction control-inhibiting means for inhibiting operation of the adherent fuel-dependent correction control during the starting condition of the engine; and carried-off fuel amount-setting means for setting the carried-off fuel amount to a predetermined value based on at least one operating parameter of the engine when the engine has shifted from the starting condition to a basic operating condition after starting.

The above and other objects, features and advantages of the invention will-become more apparent from the following detailed description taken in conjunction with the accompanying drawings.

DETAILED DESCRIPTION

The invention will now be described in detail with reference to the drawings showing an embodiment thereof.

Figure 1:
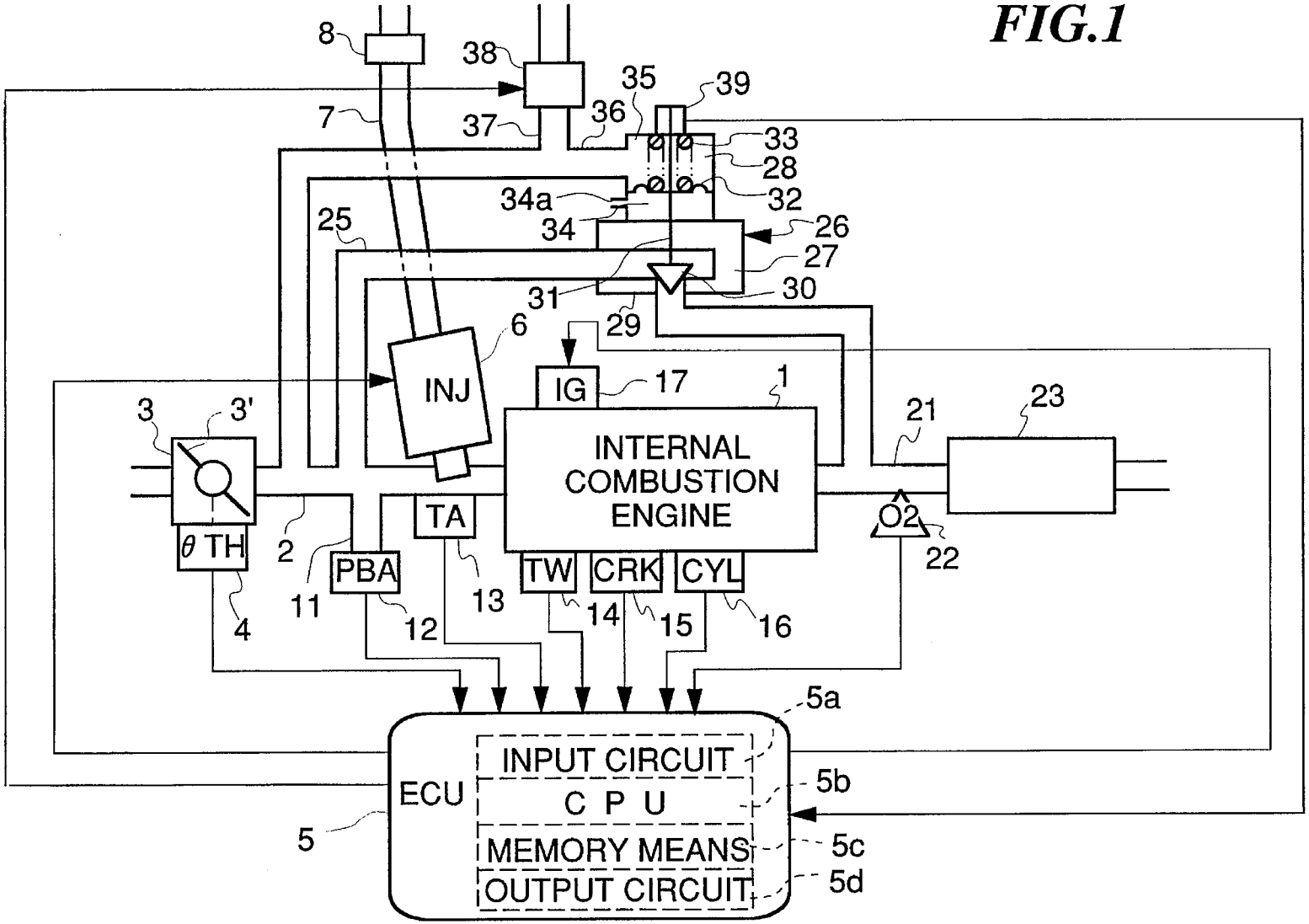
FIG. 1 is a block diagram schematically showing the whole arrangement of an internal combustion engine and a fuel injection control system therefor, according to an embodiment of the invention.

Referring first to FIG. 1, there is illustrated the whole arrangement of an internal combustion engine and a fuel injection control system therefor, according to an embodiment of the invention.

In the figure, reference numeral 1 designates a straight type four-cylinder internal combustion engine (hereinafter simply referred to as "the engine"). Connected to intake ports, not shown, of the cylinder block of the engine 1 is an intake pipe 2 across which is arranged a throttle body 3 accommodating a throttle valve 3' therein. A throttle valve opening (θTH) sensor 4 is connected to the throttle valve 3', for generating an electric signal indicative of the sensed throttle valve opening θTH and supplying the same to an electronic control unit (hereinafter referred to as "the ECU 5").

Fuel injection valves (injectors) 6, only one of which is shown, are inserted into the intake pipe 2 at locations intermediate between the cylinder block of the engine 1 and the throttle valve 3' and slightly upstream of respective intake valves, not shown. The fuel injection valves 6 are connected to a fuel pump 8 via a fuel supply pipe 7 and electrically connected to the ECU 5 to have their valve opening periods controlled by signals therefrom.

An intake pipe negative pressure (PB) sensor 12 is provided in communication with the interior of the intake pipe 2 via a conduit 11 opening into the intake pipe 2 at a location downstream of the throttle valve 3', for supplying an electric signal indicative of the sensed negative pressure PB within the intake pipe 2 to the ECU 5.

An intake air temperature (TA) sensor 13 is inserted into the intake pipe 2 at a location downstream of the conduit 11, for supplying an electric signal indicative of the sensed intake air temperature TA to the ECU 5.

An engine coolant temperature (TW) sensor 14 formed of a thermistor or the like is inserted into a coolant passage filled with a coolant and formed in the cylinder block, for supplying an electric signal indicative of the sensed engine coolant temperature TW to the ECU 5.

A crank angle (CRK) sensor 15 and a cylinder-discriminating (CYL) sensor 16 are arranged in facing relation to a camshaft or a crankshaft of the engine 1, neither of which is shown. The CRK sensor 15 generates a CRK signal pulse whenever the crankshaft rotates through a predetermined angle (e.g. 30 degrees) smaller than half a rotation (180 degrees) of the crankshaft of the engine 1. CRK signal pulses are supplied to the ECU 5, and a TDC signal pulse is generated based on CRK signal pulses. That is, a TDC signal pulse is representative of a reference crank angle position of each cylinder, and is generated whenever the crankshaft rotates through 180 degrees.

Further, the ECU 5 calculates a CRME value, which is an average value of CRK signal pulse intervals, by measuring time intervals between adjacent CRK signal pulses, and adds up CRME values over each time interval between two adjacent TDC signal pulses to obtain an ME value. Then, the engine rotational speed NE is calculated, which is the reciprocal of the ME value.

The CYL sensor 16 generates a pulse (hereinafter referred to as "the CYL signal pulse") at a predetermined crank angle (e.g. 10 degrees before TDC) of a particular cylinder of the engine assumed before a TDC position corresponding to the start of intake stroke of the particular cylinder, and the CYL signal pulse being supplied to the ECU 5.

Further, the ECU 5 sets stages of each cycle of each cylinder. More specifically, the ECU 5 sets a #0 crank angle stage corresponding to a CRK signal pulse detected immediately after generation of a TDC signal pulse. Then, the stage number is incremented by 1 whenever one CRK signal pulse is detected thereafter, thereby sequentially setting #0 stage to #5 stage for each cycle of each cylinder in the case of a four-cylinder engine which generates CRK signal pulses at intervals of 30 degrees.

Each cylinder of the engine has a spark plug 17 electrically connected to the ECU 5 to have its ignition timing controlled by a signal therefrom.

An O2 sensor 22 as an exhaust gas component concentration sensor is arranged in an exhaust pipe 21 of the engine for detecting the concentration of oxygen contained in exhaust gases and supplying an electric signal indicative of the sensed oxygen concentration to the ECU 5. A catalytic converter (three-way catalyst) 23 is arranged in the exhaust pipe 21 at a location downstream of the O2 sensor 22, for purifying noxious components, such as HC, CO, and NOx, which are present in exhaust gases.

Next, an exhaust gas recirculation (EGR) system will be described.

An exhaust gas recirculation passage 25 is arranged between the intake pipe 2 and the exhaust pipe 21 such that it bypasses the engine 1. The exhaust gas recirculation passage 25 has one end thereof connected to the exhaust pipe 21 at a location upstream of the O2 sensor 22, and the other end thereof connected to the intake pipe 2 at a location upstream of the PB sensor 12.

An exhaust gas recirculation control valve (hereinafter referred to as "the EGR valve") 26 is arranged across the exhaust gas recirculation passage 25. The EGR valve 26 is comprised of a casing 29 defining a valve chamber 27 and a diaphragm chamber 28 therein, a valving element 30 in the form of a wedge arranged in the valve chamber 27, which is vertically movable so as to open and close the exhaust gas recirculation passage 25, a diaphragm 32 connected to the valving element 30 via a valve stem 31, and a spring 33 urging the diaphragm 32 in a valve-closing direction. The diaphragm chamber 28 is divided by the diaphragm 32 into an atmospheric pressure chamber 34 on the valve stem side and a negative pressure chamber 35 on the spring side.

The atmospheric pressure chamber 34 is communicated with the atmosphere via an air inlet port 34*a*, while the negative pressure chamber 35 is connected to one end of a negative pressure-introducing passage 36. The negative pressure-introducing passage 36 has the other end thereof connected to the intake pipe 2 at a location between the throttle body 3 and the other end of the exhaust gas recirculation passage 25, for introducing the negative pressure PB into the negative pressure chamber 35. The negative pressure-introducing passage 36 has an air-introducing passage 37 connected thereto, and the air-introducing passage 37 has a pressure control valve 38 arranged therein. The pressure control valve 38 is an electromagnetic valve of a normally-closed type, and negative pressure prevailing within the negative pressure-introducing passage 37 is controlled by the pressure control valve 38, whereby a predetermined level of negative pressure is created within the negative pressure chamber 35.

A valve opening (lift) sensor 39 is provided for the EGR valve 26, which detects an operating position (lift amount) of the valving element 30 thereof, and supplies a signal indicative of the sensed lift amount to the ECU 5. The EGR control is carried out after the engine has been warmed up (e.g. when the engine coolant temperature TW exceeds a predetermined value).

The ECU 5 is comprised of an input circuit 5*a* having the functions of shaping the waveforms of input signals from various sensors including ones mentioned above, shifting the voltage levels of sensor output signals to a predetermined level, converting analog signals from analog-output sensors to digital signals, and so forth, a central processing unit (hereinafter referred to as the "the CPU") 5*b*, memory means 5*c* storing various operational programs which are executed by the CPU 5*b*, and various maps and tables, referred to hereinafter, and for storing results of calculations therefrom, etc., and an output circuit 5*d* which outputs driving signals to the fuel injection valves 6, the fuel pump 8, the spark plugs 17, etc., respectively.

Further, the ECU 5 estimates the temperature of the walls of the intake ports where part of the injected fuel can adhere (hereinafter referred to as "port wall temperature"), and sets operating parameters, based on the estimated port wall temperature, to thereby effect fuel transfer delay-dependent correction of the fuel injection amount. Further, the ECU 5 determines various operating regions of the engine, such as an air-fuel ratio feedback control region where the air-fuel ratio feedback control is carried out in response to the concentration of oxygen in exhaust gases detected by the O2 sensor 22, and open-loop air-fuel ratio control regions.

Although in the present embodiment, the TA sensor 13 is inserted into the wall of the intake pipe 2 at a location downstream of the throttle valve 3', this is not limitative, but it may be arranged upstream of the throttle valve 3'. However, the value of a middle point-setting coefficient X0, referred to hereinafter, needs to be set depending on the location of the TA sensor 13.

Now, description will be made of the fuel transfer delay-dependent correction (adherent fuel-dependent correction) of the fuel injection amount, according to the present embodiment.

Before describing details of the fuel transfer delay-dependent correction of the fuel injection amount, the principle of the fuel transfer delay-dependent correction will be described with reference to FIG. 2.

Figure 2:
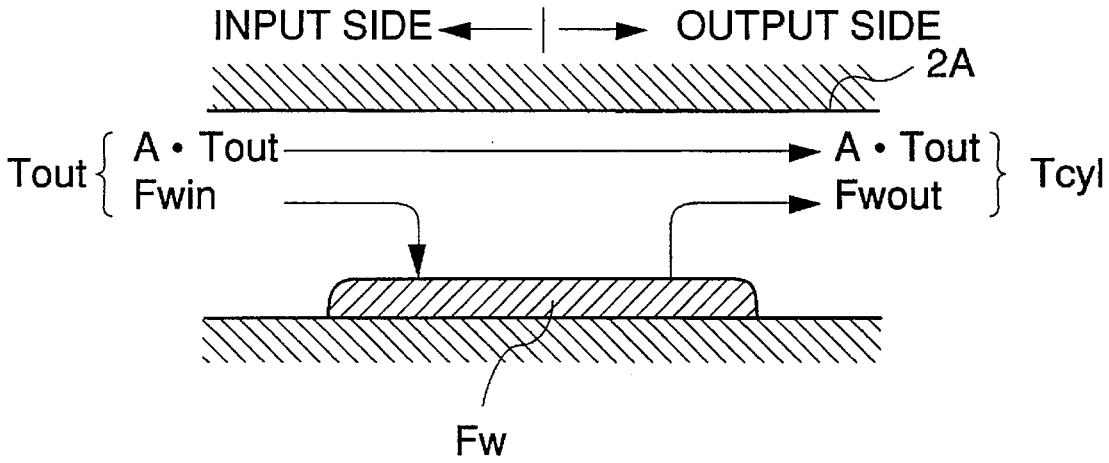
FIG. 2 is a conceptual representation of the relationship between a fuel injection amount Tout and a required fuel amount Tcyl.

FIG. 2 conceptually represents the relationship between a fuel injection amount Tout and a required fuel amount Tcyl.

The method of correcting fuel transfer delay according to the present embodiment is based on the concept that a change in the carried-off fuel amount Fwout follows up a change in the adherent fuel increment Fwin with a predetermined time delay. This relationship between the adherent fuel increment Fwin and the carried-off fuel amount Fwout is expressed e.g., by an equation of a first order-delay model in which the degree of delay of the carried-off fuel amount relative to the adherent fuel increment Fwin is represented by a delay-setting coefficient (delay time constant) T.

The fuel injection amount Tout appearing in the figure represents an amount of fuel injected via the fuel injection valve 6 into the intake pipe 2, in one cycle of the cylinder. Out of the fuel injection amount Tout, an amount (A×Tout) of a portion thereof is directly drawn into the cylinder without adhering to the wall surface of the intake port 2A, while the remainder of the fuel injection amount Tout is added as an adherent fuel increment Fwin to the adherent fuel amount Fw of fuel having adhered to the wall surface of the intake port up to the immediately preceding cycle of the cylinder, i.e. before the present injection. Here, the symbol A represents a direct supply ratio defined as the ratio of an amount of fuel directly drawn into the combustion chamber of the cylinder in one cycle of the cylinder to the whole amount of fuel injected for the cylinder in the same cycle of the cylinder, which assumes a value in the range of $0 \leq A < 1$.

The sum of the amount (A×Tout) of fuel and a carried-off fuel amount Fwout of fuel carried off the wall surface, i.e. away from the adherent fuel amount Fw forms the required fuel amount Tcyl actually supplied to the cylinder.

More specifically, the required fuel amount Tcyl is determined by the following equation (1):

$$Tcyl=A\times Tout+Fwout \quad (1)$$

Therefore, the fuel injection amount Tout can be determined by the following equation (2):

$$Tout=(Tcyl-Fwout)/A \quad (2)$$

Further, the adherent fuel increment Fwin, which represents an amount of fuel newly adhering to the wall surface, can be determined by the following equation (3):

$$Fwin=(1-A)\times Tout \quad (3)$$

Since the carried-off fuel amount Fwout is a function of the adherent fuel increment Fwin with the first-order delay, it can be expressed in a discrete representation by the following equation (4):

$$Fwout(n)=Fwout(n-1)+1/T\times(Fwin(n-1)-Fwout(n-1)) \quad (4)$$

where T represents the delay time constant which is set to a value corresponding to a time period required to elapse from the time the carried-off fuel amount Fwout starts to change with a change in the adherent fuel increment to the time the change amount reaches 63.2% of the whole change in the carried-off fuel amount Fwout. This value T is set depending on operating conditions of the engine.

According to the equation (4), the carried-off fuel amount Fwout(n) calculated for the present cycle injection is increased relative to the immediately preceding value thereof by an amount of the product of a value 1/T and a value (difference) obtained by subtracting the carried-off fuel amount Fwout in the immediately preceding cycle from the adherent fuel increment Fwin in the immediately preceding cycle. The same calculation is carried out for each cycle, whereby the carried-off fuel amount Fwout becomes closer to the adherent fuel increment Fwin by an increment of 1/T of the above difference between the values Fwout and Fwin.

Figure 3:
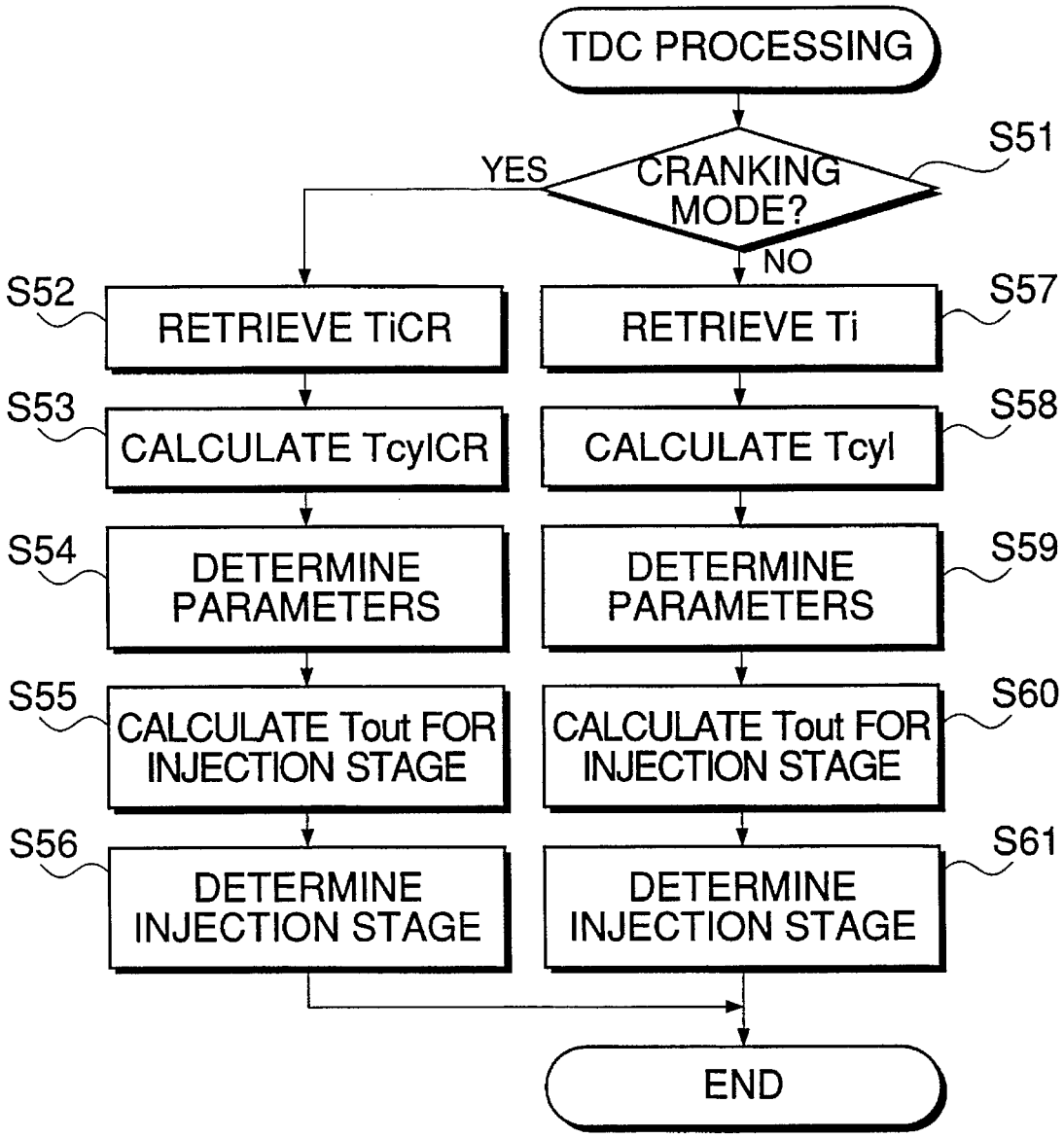
FIG. 3 is a flowchart showing a TDC processing routine.

FIG. 3 shows a TDC processing routine executed by the CPU 5*b*, in synchronism with generation of TDC signal pulses.

First, at a step S51, it is determined whether or not the engine is being started, i.e. in a cranking mode. If the answer is affirmative (YES), the program proceeds to a step S52. The determination as to the cranking mode is made by determining whether or not the engine rotational speed NE is lower than a predetermined value. At the step S52, a basic fuel injection amount TiCR for the cranking mode is determined based on the engine coolant temperature TW. At the following step S53, based on the basic fuel injection amount TiCR, the required fuel amount TcylCR for the cranking mode is calculated by the use of the following equation (5):

$$TcylCR=TiCR\times KNE\times KPACR \quad (5)$$

where TiCR represents the basic fuel injection amount as a function of the engine coolant temperature, KNE an engine rotational speed-dependent correction coefficient, and KPACR an atmospheric pressure-dependent correction coefficient.

Further, at a step S54, the direct supply ratio A and the delay time constant T are determined by respective subroutines described hereinafter. Then, at a step S55, the fuel injection period Tout for determining an injection stage for the cranking mode is calculated by the use of the following equation (6):

$$Tout=(TcylCR-Fwout)/A+TiVB \quad (6)$$

where TiVB represents an ineffective time period of the fuel injection valve, for correcting the voltage of a battery, not shown, of the engine.

At a step S56, based on the fuel injection amount for determining the injection stage in the cranking mode, the fuel injection stage is determined by the use of the following equation (7), followed by terminating the program:

$$\text{Injection stage}=(\text{Injection Termination stage})-Tout/CRME \quad (7)$$

where CRME represents the average CRK pulse interval [ms].

When the engine enters a basic operating mode after cranking so that the answer to the question of the step S51 becomes negative (NO), the program proceeds to a step S57, wherein a value of the basic fuel injection amount (map value) Ti is determined by retrieving a Ti map, not shown, according to the engine rotational speed NE and the intake pipe negative pressure PB. At the next step S58, the required fuel amount Tcyl is calculated by the use of the following equation (8):

$$Tcyl=Ti\times KTOTAL \quad (8)$$

where Ti represents the basic fuel injection amount (map value), and KTOTAL represents a product of various coefficients exclusive of an air-fuel ratio correction coefficient KO2.

More specifically, the KTOTAL value is expressed by the following equation (9):

$$KTOTAL=KLAM\times KTA\times KPA \quad (9)$$

where KLAM represents a desired air-fuel ratio coefficient, KTA an intake air temperature-dependent correction coefficient, and KPA an atmospheric pressure-dependent correction coefficient.

The desired air-fuel ratio coefficient KLAM is determined by the following equation (10):

$$KLAM=KWOT\times KTW\times KEGR\times KAST \quad (10)$$

where KWOT represents a high load (wide-open-throttle)-dependent enriching coefficient, KTW a low coolant temperature-dependent enriching coefficient, KEGR an EGR-dependent correction coefficient, and KAST an after start-dependent enriching coefficient.

Then, at a step S59, by executing subroutines referred to hereinafter, parameters indicative of the estimated port wall temperature TC, the direct supply ratio A, and the delay time constant T are determined, and then at the following step S60, the fuel injection amount Tout for determining an injection stage in the basic operating mode after cranking is calculated by the use of the following equation (11):

$$Tout=(Tcyl\times KO2-Fwout)/A+TiVB \quad (11)$$

Then, at a step S61, the injection stage is determined similarly to the step S56, followed by terminating the program.

In the calculations of the fuel injection amount Tout for determining the injection stage carried out at the steps S55 and S60, a common value is used as the carried-off fuel amount Fwout for all the cylinders, thereby simplifying the calculation processing.

Figure 4:
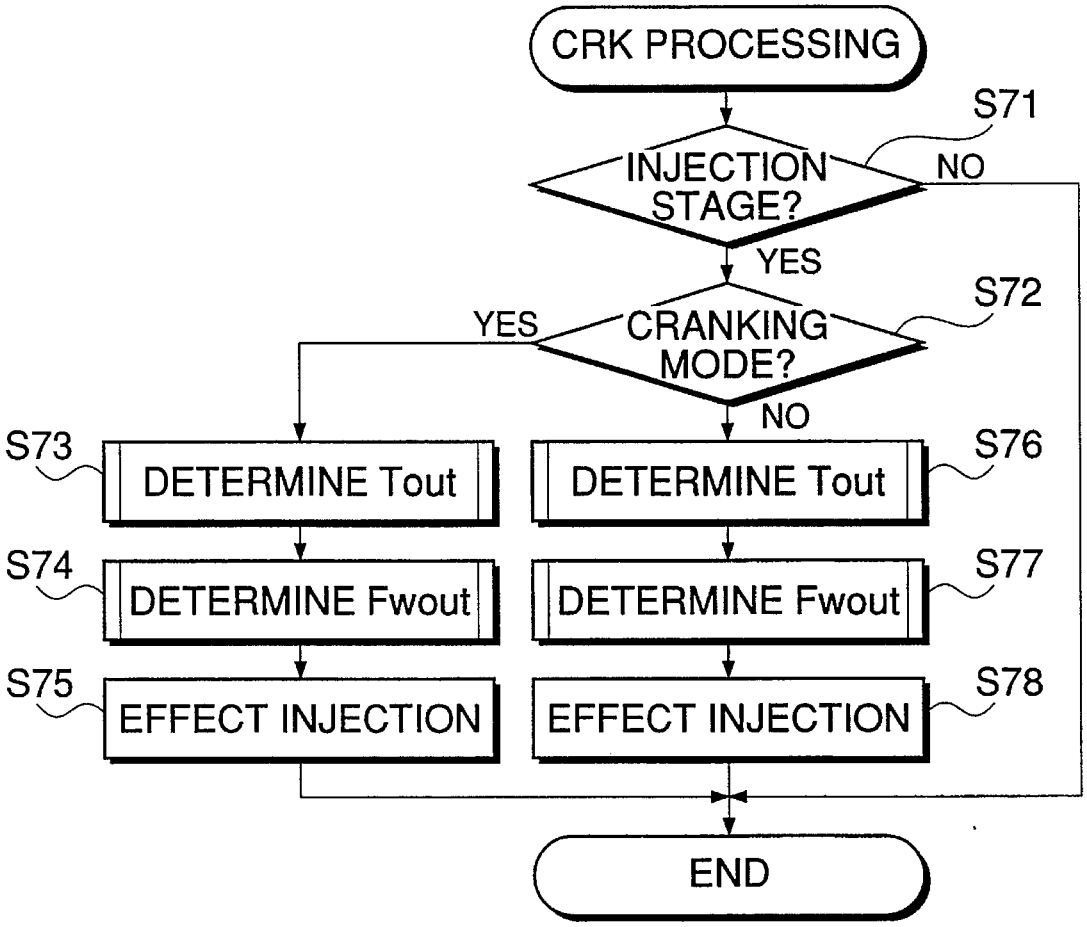
FIG. 4 is a flowchart showing a CRK processing routine.

FIG. 4 shows details of a routine for CRK processing, which is executed by the CPU 5b in synchronism with generation of CRK signal pulses.

First, at a step S71, it is determined whether or not the present crank pulse interruption corresponds to the injection stage. If the answer is negative (NO), the program is immediately terminated, whereas if the answer is affirmative (YES), the program proceeds to a step S72, wherein it is determined whether or not the engine is in the cranking mode. If the answer is affirmative (YES), the fuel injection amount Tout for the cranking mode is calculated separately for each cylinder by the use of the following equation (12), at a step S73:

$$Tout(i)=(TcylCR(i)-Fwout(i))/A+TiVB \quad (12)$$

where TcylCR(i) is calculated by the use of the above equation (5). In the equation, the symbol i (=1 to 4) designates correspondence to respective cylinders of #1 to #4.

Further, at a step S74, the carried-off fuel amount Fwout (n) (i) for the present cycle is determined separately for each cylinder by the use of the following equation (13):

$$Fwout(n)(i)=Fwout(n-1)(i)+1/T\times(Fwin(n-1)(i)-Fwout(n-1)(i)) \quad (13)$$

where the adherent fuel amount Fwin(n)(i) for the present cycle (the amount of fuel which newly adheres to the wall surface of the intake port out of the whole amount of fuel injected in the present cycle) is determined by the following equation (14):

$$Fwin(n)(i)=(1-A)\times(Tout(n)(i)-TiVB) \quad (14)$$

Thus, the fuel injection amount Tout(i) and the carried-off fuel amount Fwout(i) are calculated, and then the program proceeds to a step S75, wherein fuel injection is carried out, followed by terminating the present program.

At the start of the cranking mode, the adherent fuel amount Fwin before the initial or first injection is equal to 0, and hence the carried-off fuel amount Fwout is equal to 0. Therefore, it should be understood that the carried-off fuel amount Fwout (n) (i) in the above equation (13) represents a value assumed after the second injection or a later injection.

On the other hand, when the engine enters the basic operating mode after completion of the cranking, the answer to the question of the step S72 becomes negative (NO), and then the program proceeds to a step S76, wherein the fuel injection amount Tout after cranking is calculated separately for each cylinder by the use of the following equation (15):

$$Tout(i)=(Tcyl(i)\times KO2-Fwout(i))/A+TiVB \quad (15)$$

where the required fuel amount Tcyl(i) is calculated by the use of the above equation (8), similarly to the step S58.

Then, at a step S77, the carried-off fuel amount Fwout(n) (i) for the present cycle is determined separately for each cylinder by the use of the above equation (13), and the adherent fuel amount Fwin(n)(i) for the present cycle is also calculated by the above equation (14). Thereafter, fuel injection is carried out at a step S78, followed by terminating the program.

Figure 5:
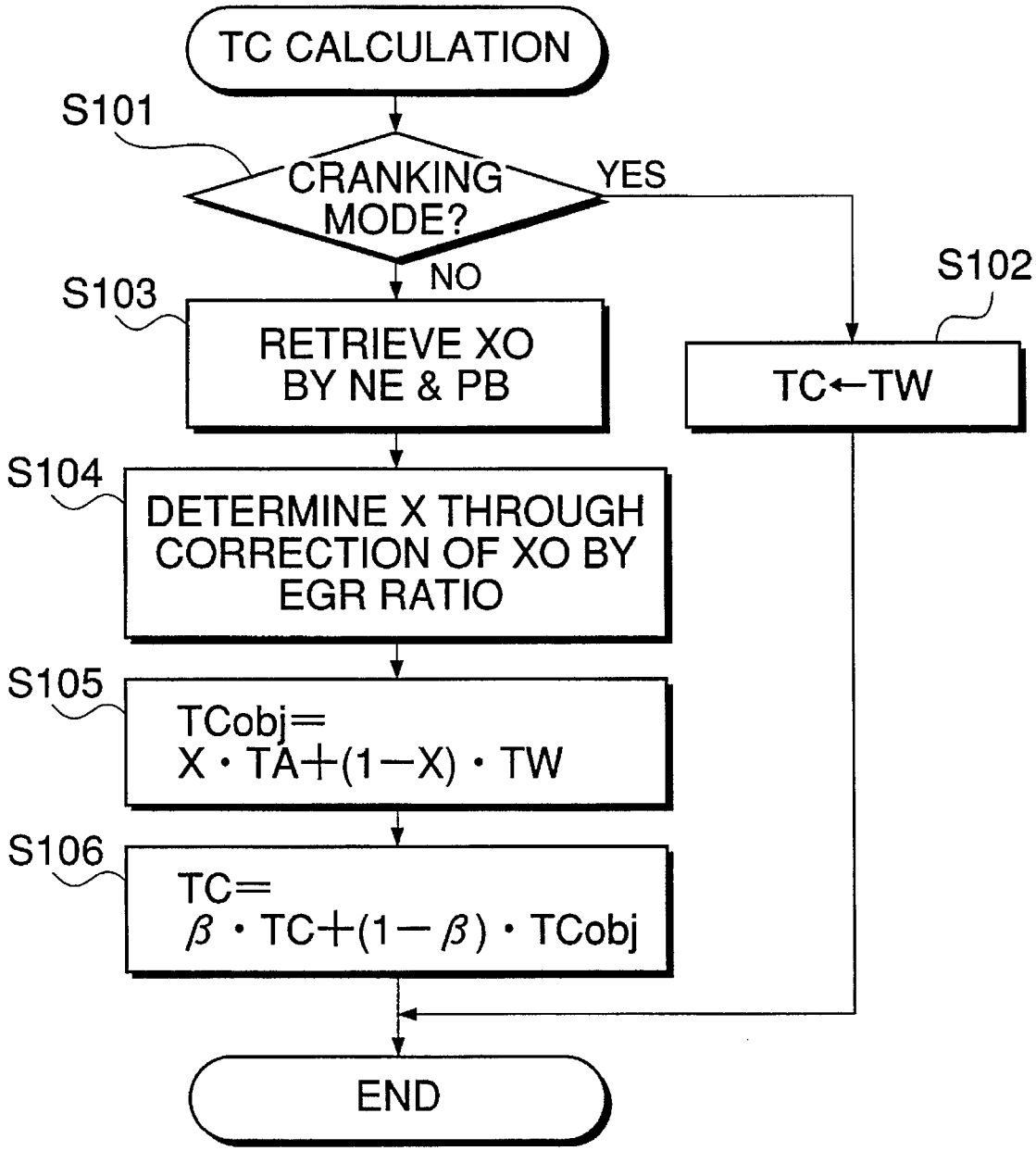
FIG. 5 is a flowchart showing an estimated intake port temperature TC-calculating routine.

FIG. 5 shows a routine for calculating the estimated intake port wall temperature TC, which is carried out based on an EGR ratio, the intake pipe negative pressure PB, the engine rotational speed NE, the engine coolant temperature TW, and the intake air temperature TA.

First, at a step S101, it is determined whether or not the engine is in the cranking mode. If the answer is affirmative (YES), a value of the engine coolant temperature TW detected in the present loop is set to the estimated port wall temperature TC at a step S102, followed by terminating the program.

On the other hand, if the engine is in the basic operating mode after cranking, and hence the answer to the question of the step S101 becomes negative (NO), a value of the middle point-setting coefficient X0(0<X0<1) is read from an NE-PB map, not shown, which is set according to the engine rotational speed NE and the intake pipe negative pressure PB, at a step S103, and the read value of the middle point-setting coefficient X0 is corrected by a correction coefficient Kx which is based on the EGR ratio (the lift amount LACT of the EGR valve 26), to thereby calculate a middle point coefficient X, by the use of the following equation (16):

$$X=X0\times Kx \quad (16)$$

The NE-PB map is set such that a map value of the middle point-setting coefficient X0, which is increased, i.e. the contribution ratio of the intake air temperature TA is increased, is read out as the engine rotational speed is higher and the load on the engine is larger.

Further, a target port wall temperature TCobj is calculated by the use of the following equation (17), at a step S105, and then a final estimated port wall temperature TC is calculated by the use of the following equation (18), at a step S106, followed by terminating the program:

$$TCobj=X\times TA+(1-X)\times TW \quad (17)$$

$$TC(n)=\beta\times TC(n-1)+(1-\beta)\times TCobj \quad (18)$$

where β represents an averaging time constant dependent on the response delay of the intake port wall temperature TC.

Figure 6:
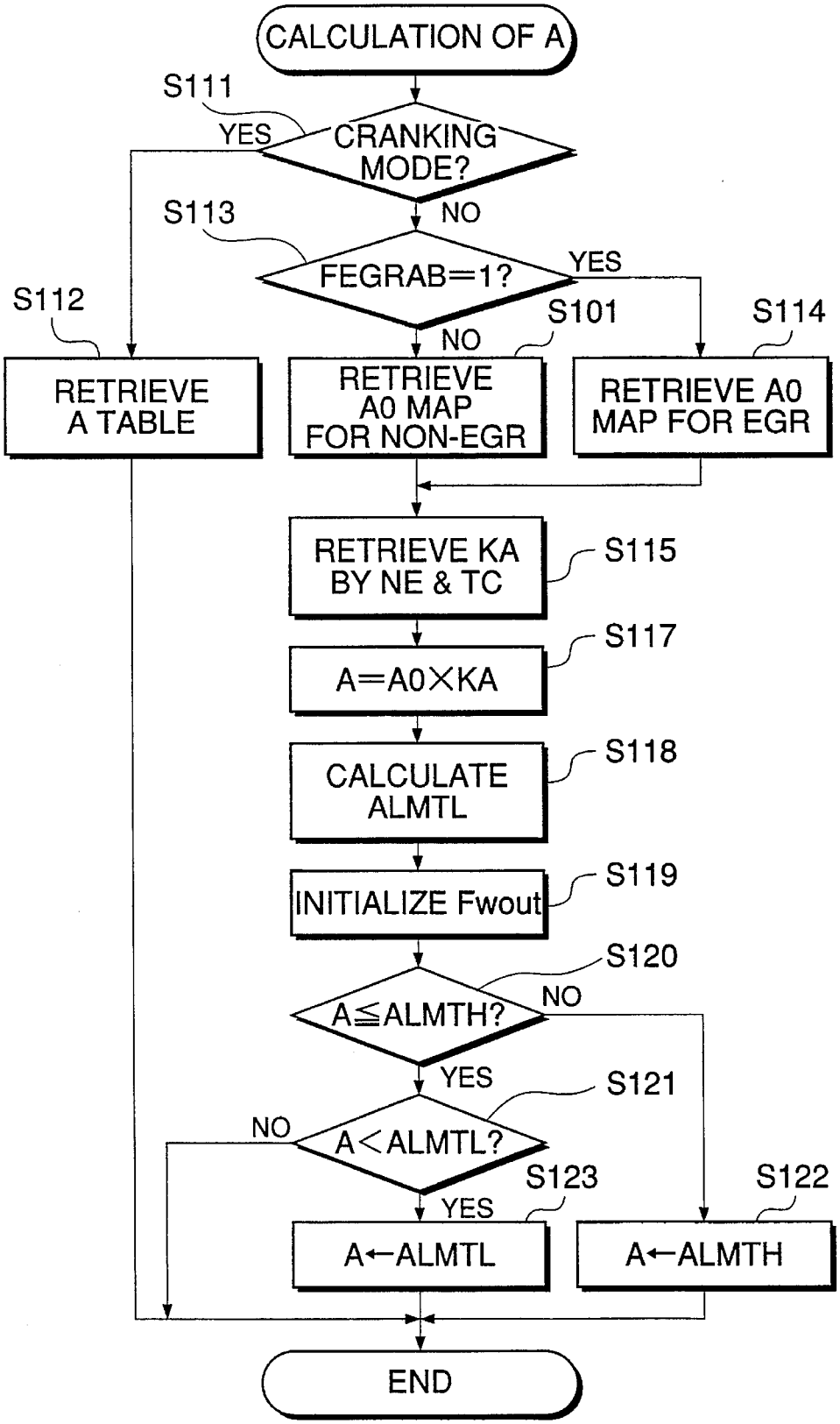
FIG. 6 is a flowchart showing a direct supply ratio A-calculating routine.

FIG. 6 shows a routine for calculating the direct supply ratio A used in the fuel transfer delay-dependent correction of the fuel injection amount.

First, at a step S111, it is determined whether or not the engine is in the cranking mode. If the answer is affirmative (YES), the program proceeds to a step S112, wherein a TW-A table, not shown, in which a table value of the direct supply ratio A, which is larger as the engine coolant temperature TW is higher, is read out, is retrieved to determine a value of the direct supply ratio A according to the engine coolant temperature TW detected in the present loop, followed by terminating the program. According to the present embodiment, the fuel transfer delay-dependent correction in the cranking mode is limited (the correction amount is decreased) relative to the correction in the basic operating mode after cranking, and therefore table values of the direct supply ratio A for the cranking mode are set to values closer to 1.0 relative to values for the basic operating mode. Thus, excessive correction can be prevented in the cranking mode.

On the other hand, if the engine is operating in the basic operating mode after cranking so that the answer to the question of the step S111 is negative (NO), the program proceeds to a step S113, wherein a flag FEGRAB, which is set to "1" when the EGR is being carried out, is equal to "1". If the answer is affirmative (YES), the program proceeds to a step S114, wherein an A0 map for EGR condition, not shown, is retrieved to determine a value of a basic direct supply ratio A0 for EGR region, according to the engine rotational speed NE and the intake pipe negative pressure PB, followed by the program proceeding to a step S115. On the other hand, if the answer is negative (NO), the program proceeds to a step S116, wherein an A0 map for non-EGR condition, not shown, is retrieved to determine a value of a basic direct supply ratio A0 for non-EGR region, according to the engine rotational speed NE and the intake pipe negative pressure PB, followed by the program proceeding to the step S115.

At the step S115, a KA map, not shown, is retrieved to determine a direct supply ratio correction coefficient KA according to the estimated port wall temperature TC calculated by the FIG. 5 routine, and the engine rotational speed NE, and then at the following step S117, the direct supply ratio A for the basic operating mode after cranking is calculated by the following equation (19):

$$A=A0\times KA \tag{19}$$

The KA map is set such that 0<KA<1, and a map value of the correction coefficient KA, which is larger, is read out as the estimated port wall temperature TC is higher. When the estimated port wall temperature TC is equal to 80° C., a map value of 1 is read out.

Then, at a step S118, a lower limit value ALMTL of the direct supply ratio A is calculated, and at the following step S119, the carried-off fuel amount Fwout is initialized. Specifically, this processing is executed by a subroutine shown in FIG. 7.

Figure 7:
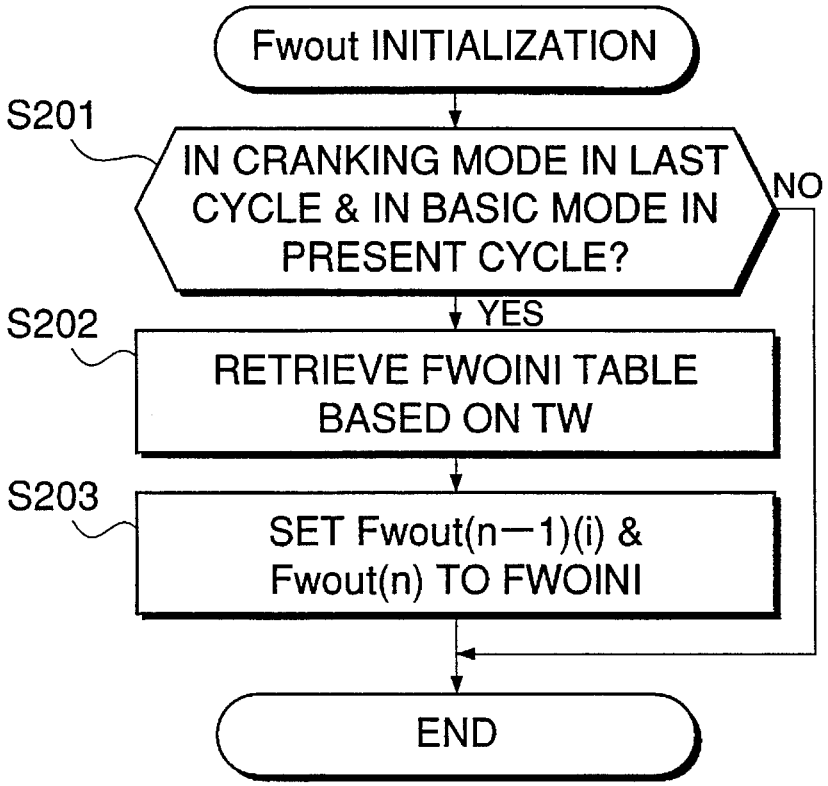
FIG. 7 is a flowchart showing a subroutine for initializing a carried-off fuel amount Fwout, which is executed during the FIG. 6 routine.

In the subroutine of FIG. 7, first, it is determined at a step S201 whether or not the engine was in the cranking mode in the immediately preceding loop of execution of the routine and is in the basic operating mode in the present loop. If the answer is negative (NO), i.e. if the engine was also in the basic operating mode in the immediately preceding loop, which means that initialization of the Fwout value has been completed, and therefore the program is immediately terminated.

Figure 8:
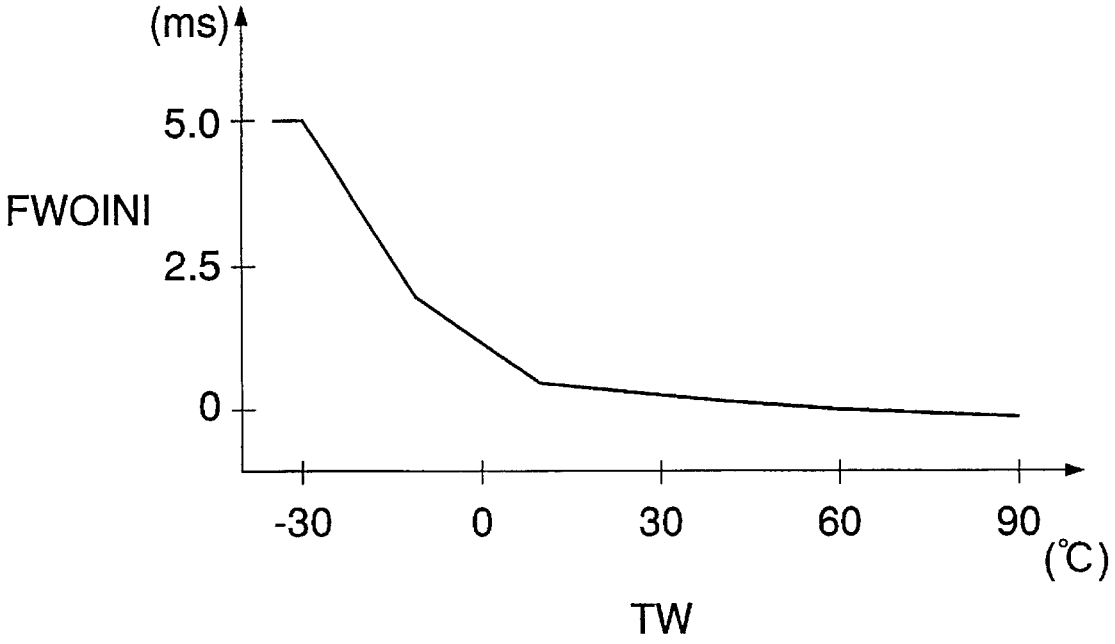
FIG. 8 shows a table which is used for determining an initial value FWOINI of the Fwout value from the engine coolant temperature TW.

On the other hand, if the present loop is immediately after termination of the cranking mode, the program proceeds to a step S202, wherein an FWOINI table which is set according to the engine coolant temperature TW is retrieved to thereby determine an initial value FWOINI of the Fwout value. The FWOINI table is set, as shown in FIG. 8, such that a map value of the FWOINI value, which is increased, is read out as the engine coolant temperature TW is lower. This setting is based on the fact that when the engine coolant temperature TW is low, the temperature of a fuel-adhering portion of the intake pipe becomes low and also the required fuel amount in the cranking mode is calculated to an increased value, which results in an increase in the adherent fuel amount Fw and hence an increase in the carried-off fuel amount Fwout.

At the following step S203, the carried-off fuel amount Fwout(n−1)(i) for each cylinder and the carried-off fuel amount Fwout (n) for calculating the injection stage are each set to the initial value FWOINI, followed by terminating the present routine.

Thus, the carried-off fuel amount Fwout immediately after termination of the cranking mode can be set to a suitable value, to thereby improve the accuracy of the transfer delay-dependent correction immediately after termination of the cranking mode of the engine.

Referring again to the FIG. 6 program, at subsequent steps S120 to S123, limit-checking of the direct supply ratio A is carried out. More specifically, the direct supply ratio A is limited to a range defined by a lower limit value ALMTL and an upper limit value ALMTH, i.e. in a range of ALMTL≦A≦ALMTH, followed by terminating the present routine.

Figure 9:
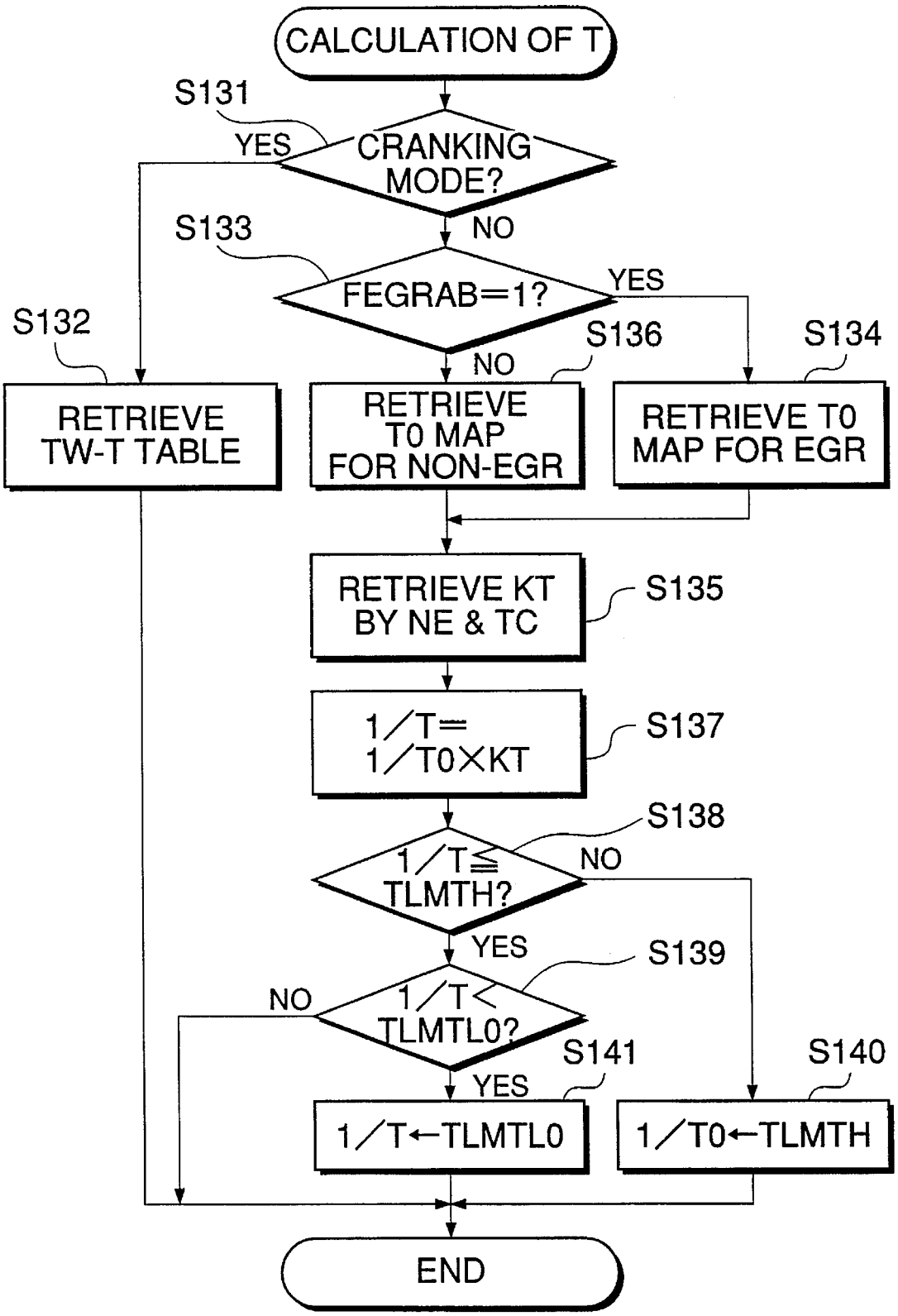
FIG. 9 is a flowchart showing a delay time constant T-calculating routine.

FIG. 9 shows a routine for calculating the delay time constant T used in the fuel transfer delay-dependent correction.

First, at a step S131, it is determined whether or not the engine is in the cranking mode. If the answer is affirmative (YES), a TW-T table, not shown, is retrieved to determine the delay time constant T according to the engine coolant temperature TW detected in the present loop, at a step S132. The TW-T table is set such that the higher the engine coolant temperature TW, the smaller a table value of the delay time constant T which is read out i.e. its reciprocal 1/T is set to a larger value as the TW value is higher.

In the present embodiment, the fuel transfer delay-dependent correction in the cranking mode is limited relative to the correction in the basic operating mode after cranking, and therefore table values of the delay time constant T are set to values closer to 0 relative to values for the basic operating mode, i.e. 1/T assumes a very large value. Consequently, almost all adherent fuel can be carried off without delay. Thus, the fuel transfer delay-dependent correction in the cranking mode is substantially limited, to thereby prevent excessive correction of the fuel transfer delay.

On the other hand, if the engine is in the basic operating mode after cranking in the present loop, so that the answer to the question of the step S131 is negative (NO), the program proceeds to a step S133, wherein it is determined whether or not the flag FEGRAB is equal to "1". If the answer is affirmative (YES), the program proceeds to a step S134, wherein a T0 map for EGR condition, not shown, is retrieved to determine a basic delay time constant T0 for EGR region, according to the engine rotational speed NE and the intake pipe negative pressure PB, followed by the program proceeding to a step S135.

If the EGR is not being carried out, i.e. if the answer to the question of the step S133 is negative (NO), the program proceeds to a step S136, wherein a T0 map for non-EGR condition, not shown, is retrieved to determine a basic delay time constant T0 for non-EGR region, followed by the program proceeding to the step S135.

At the step S135, a delay time constant correction coefficient KT is retrieved from a KT map according to the estimated port wall temperature TC, which has been calculated according to the estimated port wall temperature TC-calculating routine of FIG. 5, and the engine rotational speed NE, and at the following step S137, the reciprocal of the delay time constant T is calculated by the use of the following equation (20):

$$1/T=1/T0\times KT \tag{20}$$

The KT map is set such that the correction coefficient KT assumes a value within the range of 0 to 1, i.e. 0<KT<1, and the higher the estimated port wall temperature TC, the larger value a map value of the correction coefficient KT, which is read out. When the estimated intake port wall temperature TC is equal to 80° C., the correction coefficient KT is set to 1.

At subsequent steps S138 to S141, limit-checking of the 1/T value is carried out. More specifically, the 1/T value is limited to a range between a lower limit value TLMTL and an upper limit value TLMTH, i.e. TLMTL≦1/T≦TLMTH, followed by terminating the program.

As described above, according to the present embodiment, when the engine 1 is in the cranking mode, the fuel transfer delay-dependent correction (adherent fuel-dependent correction) is limited relative to the correction in the basic operating mode after cranking, and therefore, excessive correction of the fuel transfer delay in the cranking mode can be prevented. Further, immediately after termination of the cranking mode, the carried-off fuel amount Fwout is initialized according to the engine coolant temperature TW, and therefore the accuracy of the fuel transfer delay-dependent correction in the basic operating mode after cranking can be improved.

Figure 10:
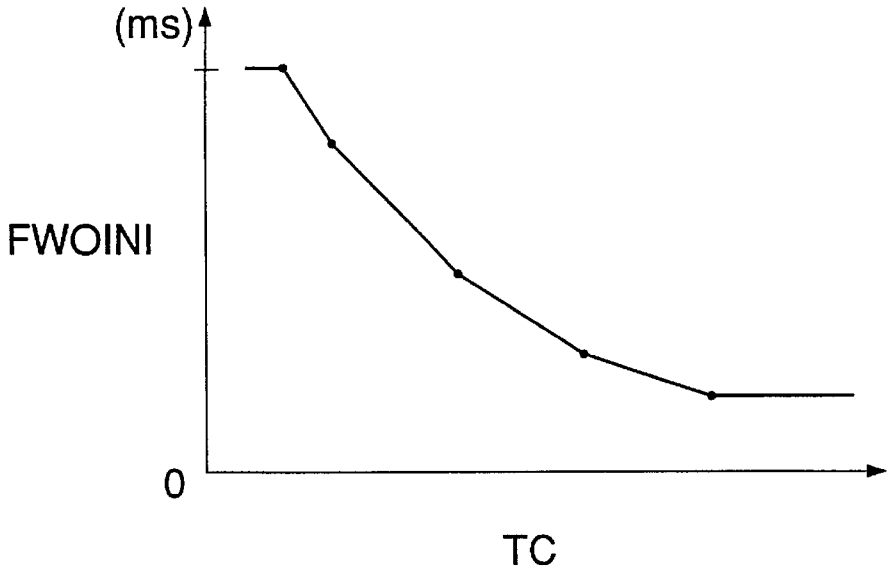
FIG. 10 shows a table which is used for determining the initial value FWOINI from the estimated port wall temperature TC.

Although in the above embodiment the initial value FWOINI of the Fwout value is set based on the engine coolant temperature TW at the step S202 in FIG. 7, this is not limitative, but it may be set based on the estimated port wall temperature TC, as shown in FIG. 10. If the initial value FWOINI is set based on the estimated port wall temperature TC, a more suitable value can be obtained as the initial value FWOINI especially at the restart of the engine in a warmed-up state (hot restarting of the engine).

Further, according to the above embodiment, the fuel transfer delay-dependent correction in the cranking mode is limited by setting the direct supply ratio A for the cranking mode and the delay time constant T for the cranking mode to values closer to 1.0 and closer to 0, respectively. But, this is not limitative. Alternatively, only one of the direct supply ratio A and the delay time constant T may be set to such a closer value, or the fuel transfer delay-dependent correction may be completely inhibited when the engine is in the cranking mode. If the correction is not carried out at all during the cranking mode, the fuel injection amount Tout, which is calculated at the step S55 in FIG. 3 and at the step S73 in FIG. 4, should be calculated by the use of the following equation (21), wherein calculations of the carried-off fuel amount Fwout, the direct supply ratio A, and the delay time constant T for the cranking mode are omitted:

$$Tout=TcylCR+TiVB \quad (21)$$

FIGS. 11A to 11D show timing charts useful in explaining, for the purpose of comparison, results of the conventional fuel injection control systems and the fuel injection control system according to the present invention, which is modified with respect to the above described embodiment such that the fuel transfer delay-dependent correction is not effected in the cranking mode of the engine. In the figures, the time interval between time points t0 and t1 corresponds to the cranking mode, and the time interval after the time point t1 corresponds to the basic operating mode. Numerical values on the ordinate in each timing chart are provided only for facilitation of the comparison between FIGS. 11A to 11D and therefore do not represent significant values.

Figure 11A:
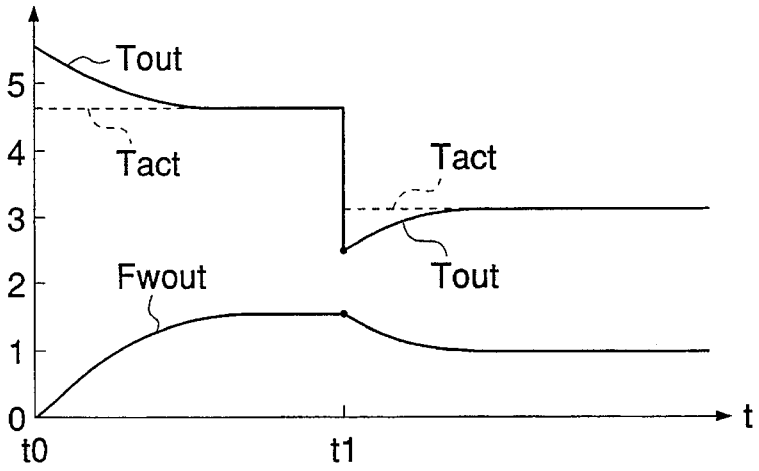
FIGS. 11A to 11D are timing charts showing results of conventional fuel injection control systems and the fuel injection control system according to the present invention.
Figure 11B:
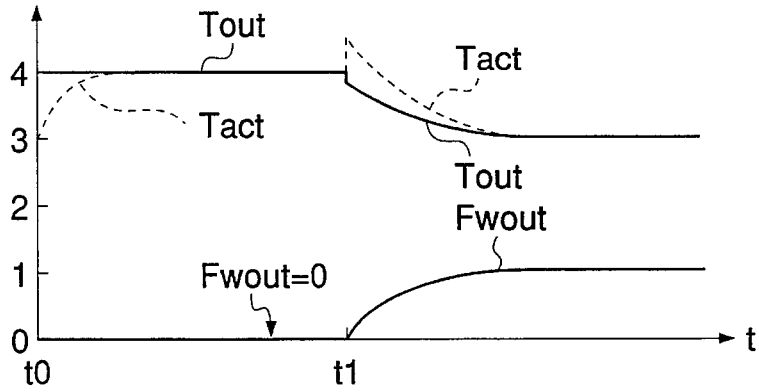
Figure 11C:
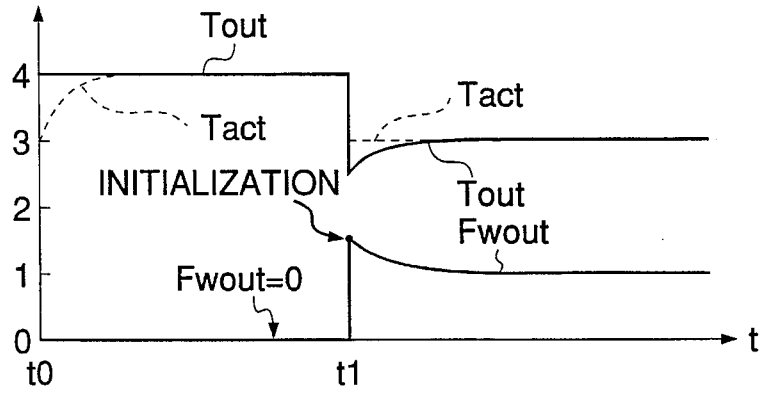
Figure 11D:
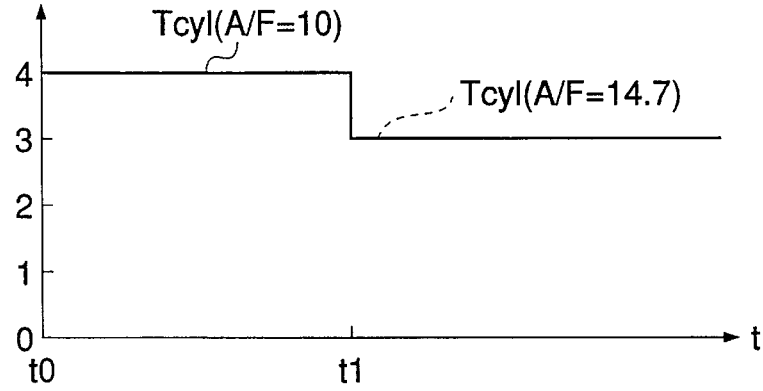

FIG. 11D shows the required fuel amount Tcyl in the cranking mode as well as in the basic operating mode. According to the illustrated example, the Tcyl value corresponds to an air-fuel ratio A/F of 10 in the cranking mode, and to an A/F value of 14.7 in the basic operating mode.

FIG. 11A shows an example of the conventional fuel injection control system in which the adherent fuel-dependent correction is carried out in the cranking mode as well as in the basic operating mode. At the start of the cranking mode, the carried-off fuel amount Fwout is small, and therefore the fuel injection amount Tout is set to a large value in order that a fuel amount Tact actually drawn into the cylinder is equal to the required fuel amount Tcyl. However, as described before, since the estimation accuracy of the adherent fuel-dependent control parameters (A and T) is low in the cranking mode, the Tact value (=4.5) deviates from the required value Tcyl (=4.0). Besides, the parameters for the cranking mode do not depend on the intake pipe negative pressure PB and the engine rotational speed NE, though not shown in the figure. As a result, the Tact value may vary with fluctuations in the engine rotational speed. In the illustrated example, the Tout value is decreased based on the Fwout value at the time point t1, and therefore the Tact value is seen to assume a value close to the required value Tcyl (=3.0).

FIG. 11B shows an example of another conventional system in which the adherent fuel-dependent correction is not carried out in the cranking mode and the carried-off fuel amount Fwout is not initialized at the time point t1. In this example, the Fwout value is set to 0 during the cranking mode, and consequently the Tout value is set to a larger value at the time point t1 in order to satisfy the required fuel amount (=3.0). In actuality, however, a certain amount of fuel actually adheres to the wall surface of the intake port, and therefore the actual Tact value becomes excessive, resulting in overriching of the air-fuel ratio.

FIG. 11C shows an example of the fuel injection control system according to the present invention in which the adherent fuel-dependent correction is not carried out in the cranking mode and the carried-off fuel amount Fwout is initialized at the time point t1. In this example, the result in the cranking mode is identical with that of the example of FIG. 11B, however, by virtue of the initialization of the Fwout value at the time point t1, the Tout value is decreased, to thereby obtain a value of the fuel amount Tact almost equal to the required fuel amount Tcyl.

What is claimed is:

1. In a fuel injection control system for an internal combustion engine having an intake passage having a wall surface, and at least one combustion chamber, including adherent fuel-dependent correction control means for carrying out adherent fuel-dependent correction by calculating an amount of fuel to be injected into said intake passage such that a sum of a direct supply amount of fuel directly drawn into said combustion chamber of said engine without adhering to said wall surface of said intake passage out of a whole amount of fuel injected into said intake passage, and a carried-off amount of fuel carried off said wall surface of said intake passage into said combustion chamber out of fuel adhering to said wall surface of said intake passage is equal to a required fuel amount for said engine, the improvement comprising:

engine start-detecting means for detecting a starting condition of said engine;

adherent fuel-dependent correction control-limiting means for limiting operation of said adherent fuel-dependent correction control during said starting condition of said engine; and carried-off fuel amount-setting means for setting said carried-off fuel amount to a predetermined value based on at least one operating parameter of said engine when said engine has shifted from said starting condition to a basic operating condition after starting.

2. A fuel injection control system as claimed in claim 1, wherein said at least one operating parameter of said engine is coolant temperature of said engine, said carried-off fuel amount-setting means setting said predetermined value to a larger value as said coolant temperature of said engine is lower.

3. A fuel injection control system as claimed in claim 1, including wall surface temperature-estimating means for estimating temperature of said wall surface of said intake passage, based on at least one operating parameter of said engine, and wherein said carried-off fuel amount-setting means sets said predetermined value to a larger value as the estimated temperature of said wall surface of said intake passage is lower.

4. A fuel injection control system as claimed in claim 1, wherein said adherent fuel-dependent correction control-limiting means sets a parameter representative of said direct supply amount of fuel to such a value that said adherent fuel-dependent correction control is carried out to a limited degree.

5. A fuel injection control system as claimed in claim 1, wherein said adherent fuel-dependent correction control means calculates said amount of fuel to be injected into said intake passage, based on said direct supply amount of fuel, said carried-off amount of fuel, and a parameter representative of a time delay with said carried-off amount of fuel is carried off into said combustion chamber, said adherent fuel-dependent correction control-limiting means setting said parameter representative of said time delay to such a value that said adherent fuel-dependent correction control is carried out to a limited degree.

6. A fuel injection control system as claimed in claim 4, wherein said adherent fuel-dependent correction control means calculates said amount of fuel to be injected into said intake passage, based on said direct supply amount of fuel, said carried-off amount of fuel, and a parameter representative of a time delay with said carried-off amount of fuel is carried off into said combustion chamber, said adherent fuel-dependent correction control-limiting means setting said parameter representative of said time delay to such a value that said adherent fuel-dependent correction control is carried out to a limited degree.

7. In a fuel injection control system for an internal combustion engine having an intake passage having a wall surface, and at least one combustion chamber, including adherent fuel-dependent correction control means for carrying out adherent fuel-dependent correction by calculating an amount of fuel to be injected into said intake passage such that a sum of a direct supply amount of fuel directly drawn into said combustion chamber of said engine without adhering to said wall surface of said intake passage out of a whole amount of fuel injected into said intake passage, and a carried-off amount of fuel carried off said wall surface of said intake passage into said combustion chamber, out of fuel adhering to said wall surface of said intake passage is equal to a required fuel amount for said engine, the improvement comprising:

engine start-detecting means for detecting a starting condition of said engine;

adherent fuel-dependent correction control-inhibiting means for inhibiting operation of said adherent fuel-dependent correction control during said starting condition of said engine; and carried-off fuel amount-setting means for setting said carried-off fuel amount to a predetermined value based on at least one operating parameter of said engine when said engine has shifted from said starting condition to a basic operating condition after starting.

8. A fuel injection control system as claimed in claim 7, wherein said at least one operating parameter of said engine is coolant temperature of said engine, said carried-off fuel amount-setting means setting said predetermined value to a larger value as said coolant temperature of said engine is lower.

9. A fuel injection control system as claimed in claim 7, including wall surface temperature-estimating means for estimating temperature of said wall surface of said intake passage, based on at least one operating parameter of said engine, and wherein said carried-off fuel amount-setting means sets said predetermined value to a larger value as the estimated temperature of said wall surface of said intake passage is lower.

* * * * *